US007814621B1

(12) United States Patent
Radke

(10) Patent No.: US 7,814,621 B1
(45) Date of Patent: Oct. 19, 2010

(54) STAY-CLOSED HINGE

(76) Inventor: Todd F. Radke, 418 Broadway St., Chico, CA (US) 95928

( * ) Notice: Subject to any disclaimer, the term of this patent is extended or adjusted under 35 U.S.C. 154(b) by 315 days.

(21) Appl. No.: 11/558,370

(22) Filed: Nov. 9, 2006

(51) Int. Cl.
*E05D 11/10* (2006.01)

(52) U.S. Cl. ..... 16/335; 16/230; 16/231; 16/321; 16/325; 16/331; 16/374; 16/375; 16/388; 16/389

(58) Field of Classification Search ..... 16/321, 16/325, 331, 335, 374–375, 388–389, 231, 16/230
See application file for complete search history.

(56) References Cited

U.S. PATENT DOCUMENTS

| | | | | | |
|---|---|---|---|---|---|
| 919,154 | A * | 4/1909 | Gen | 16/335 |
| 1,416,188 | A * | 5/1922 | Garman | 74/579 R |
| 1,675,791 | A * | 7/1928 | Carr | 24/623 |
| 1,705,820 | A * | 3/1929 | Lansing | 16/65 |
| 2,526,209 | A * | 10/1950 | Durup | 16/336 |
| 2,571,430 | A * | 10/1951 | Durup | 16/335 |
| 2,577,456 | A * | 12/1951 | Doman | 16/337 |
| 3,036,331 | A * | 5/1962 | Skolnik | 16/224 |
| 3,061,137 | A * | 10/1962 | Svoboda et al. | 220/840 |
| 3,107,390 | A * | 10/1963 | Shelton | 16/224 |
| 3,255,484 | A * | 6/1966 | Macdonald | 16/278 |
| 3,349,429 | A * | 10/1967 | Suska | 16/275 |
| 3,418,683 | A * | 12/1968 | Stone et al. | 16/335 |
| 3,439,377 | A * | 4/1969 | Bucholz | 16/389 |
| 3,685,094 | A * | 8/1972 | Goossev | 16/224 |
| 4,063,330 | A * | 12/1977 | Triplette | 16/321 |
| 5,282,293 | A * | 2/1994 | Pedoeem | 16/342 |
| 5,355,559 | A * | 10/1994 | Bowers et al. | 16/389 |
| 5,392,493 | A * | 2/1995 | Youngdale | 16/237 |
| 5,956,809 | A * | 9/1999 | Hodgson | 16/224 |
| 6,353,966 | B1 * | 3/2002 | King | 16/235 |
| 2004/0034969 | A1 * | 2/2004 | Wegman | 16/389 |

* cited by examiner

*Primary Examiner*—Victor Batson
*Assistant Examiner*—Roberta Delisle
(74) *Attorney, Agent, or Firm*—William Bodnar

(57) ABSTRACT

The present invention relates to a door hinge that allows a door to stay closed without the use of additional hardware. Conventional hinges merely support the door they are mounted on. The unique features of the hinge of the present invention allow a door to remain closed due to the integral strike and catch components of the hinge itself. This eliminates the time and expense for installation of traditional mechanical or magnetic closure systems on the non-hinge end of the door and frame.

3 Claims, 5 Drawing Sheets

STAY-CLOSED HINGE

CROSS REFERENCE TO RELATED APPLICATIONS

None.

FIELD OF THE INVENTION

The present invention generally relates to the field of cabinetry and more specifically to hinges for cabinetry doors.

BACKGROUND

Examples of the invention disclosed herein relate generally to hinges for mounting a substantially rectangular door for swinging between open and closed positions. In more specific examples, the invention relates to hinges for mounting what is known as an overlay door to a cabinet and defines the front opening of the cabinet. When the door is closed, the back side of the door is approximately parallel with and spaced forward from the side panels or the cabinet case.

Conventional hinges support the doors on cabinetry. The door typically remains in a closed position via use of mechanical or magnetic catches mounted on the non-hinge end of the door and a mating area of the cabinet. There remains a need for a hinge that can both support a cabinet door and keep it in a closed position without the use of additional hardware.

SUMMARY

The general aim of examples of the present invention is to provide a new and improved door hinge which may be easily installed, easily adjusted, and will provide a closing mechanism without the use of exterior hardware. Examples of the invention also provide a hinge having a "stay-closed" feature that will withstand forces which lead to inadvertent opening of the door.

Examples of the invention also eliminate the need for time-consuming installation and adjustment of traditional magnetic or mechanical catches to hold a door in a closed position. Feature include specially configured strikes and catches incorporated into the hinge for securing a door to a cabinet frame.

The full scope of the advantages of these examples will become more apparent from the following detailed description when taken in conjunction with the accompanying drawings.

BRIEF DESCRIPTION OF THE DRAWINGS

FIGS. 8 and 9 show unattached hinges utilizing different strike and catch configurations.

DETAILED DESCRIPTION OF THE DRAWINGS

Figure 1:
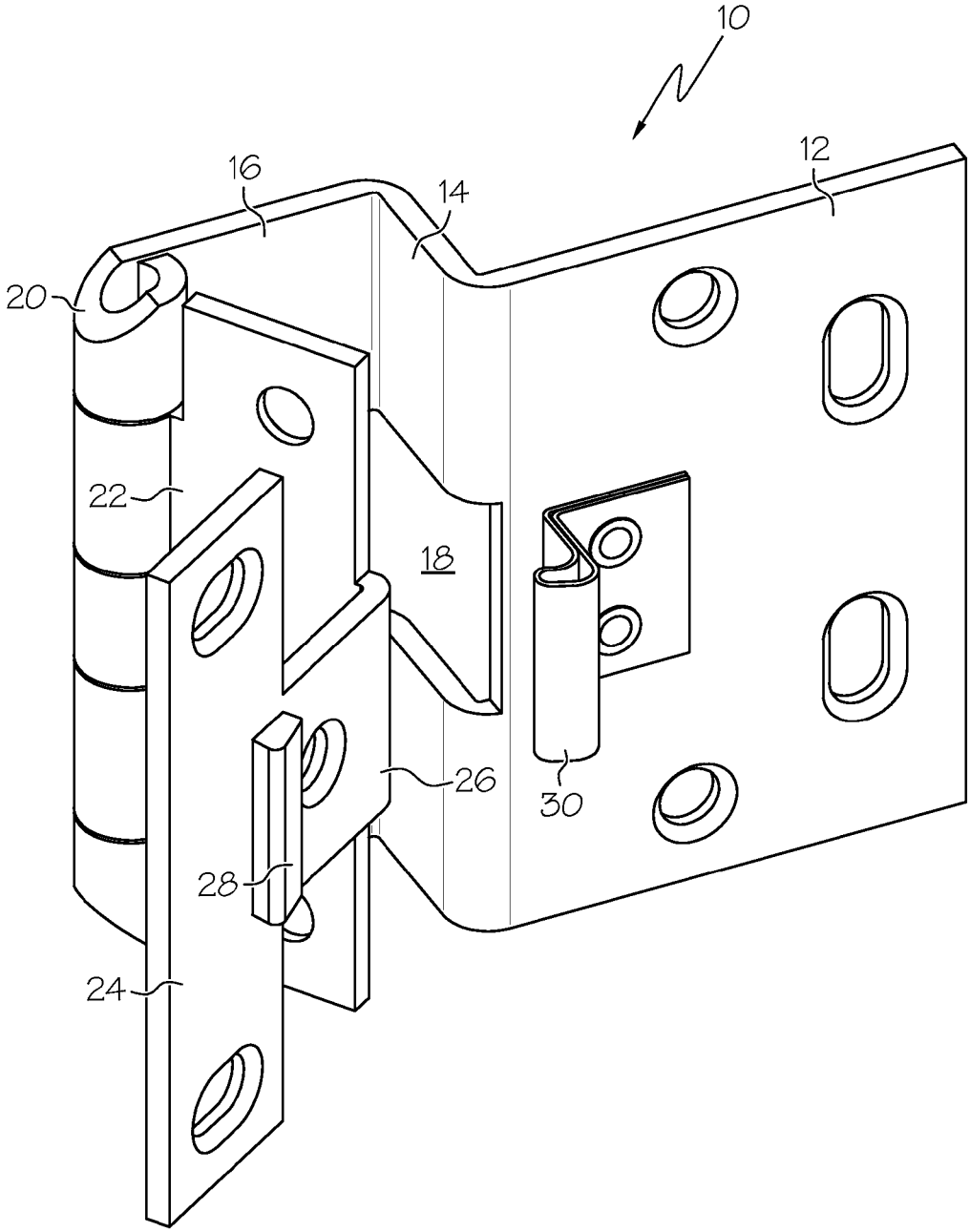
FIG. 1 is a perspective view of an unattached, cabinet hinge incorporating the unique features of the present invention.

As shown in the drawings for purposes of illustration, an example of the invention is embodied in a hinge 10 for mounting an upright and generally rectangular door for swinging about an upright axis between open and closed positions with respect to a cabinet. Typically, the door is mounted by two or more vertically spaced hinges.

FIG. 1 shows the hinge 10 has a frame wing composed of first frame wing flange 12, second frame wing flange 14 and third frame wing flange 16 respectively. The hinge also includes a door wing comprised of first door wing flange 24 and section door wing flange 22. There is a narrow section 26 of first door wing flange 24. This narrow section 26 is designed to fit into the aperture 18 of the second wing flange 14 when the hinge is closed thus allowing a cabinet door to be flush with the cabinet face frame when the door is closed.

The frame wing and door wing are joined at the hinge knuckles 26. The strike 28 is shown mounted to the door wing and the catch 30 is mounted to the frame wing.

Figure 2:
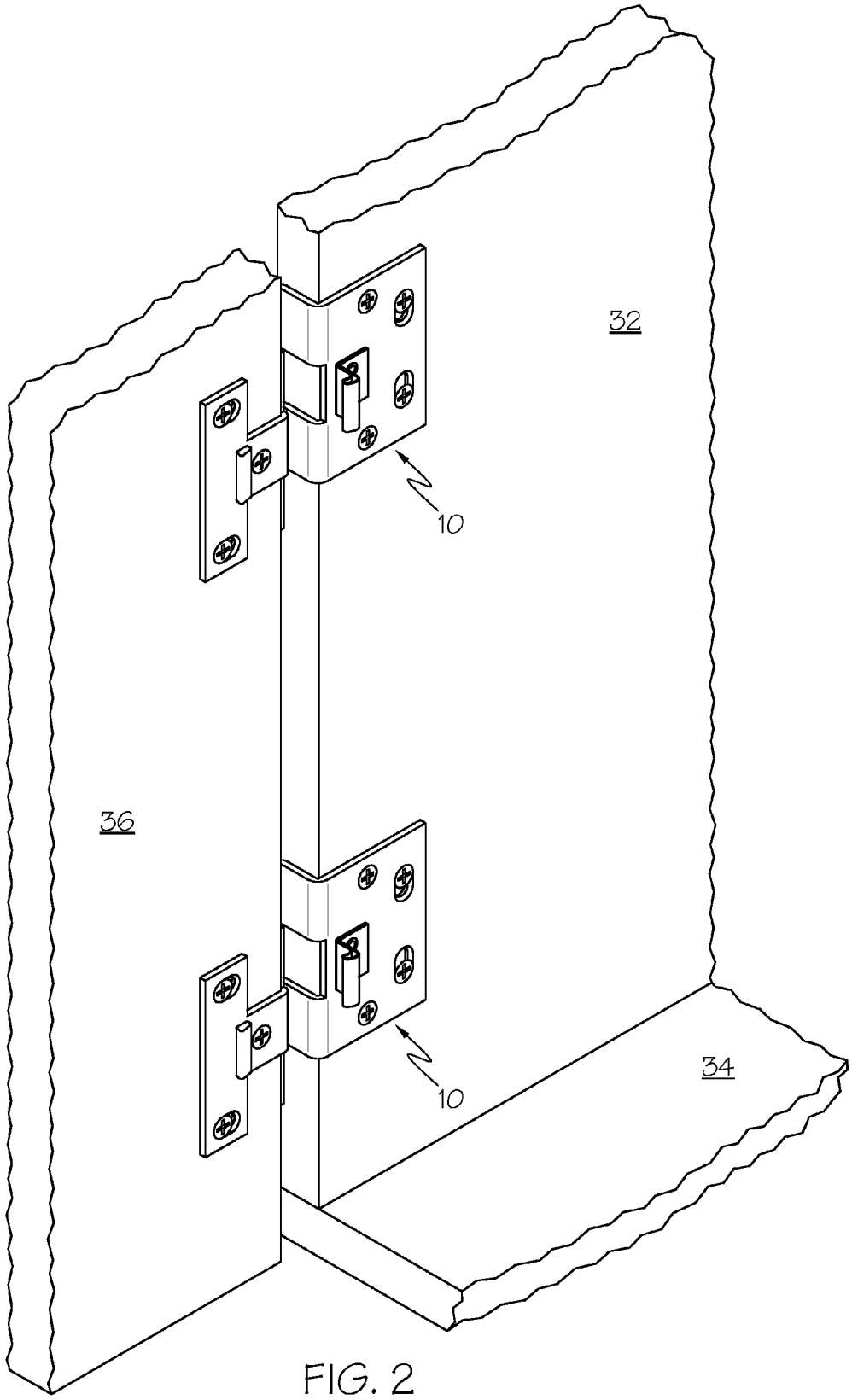
FIG. 2 is a perspective view showing two hinges mounted on the cabinet frame and the cabinet door.

Upper and lower hinges are shown installed on a cabinet frame 32 and cabinet door 36 in FIG. 2. FIGS. 3 through 7 show top views of a hinge illustrating incremental positions.

Figure 3:
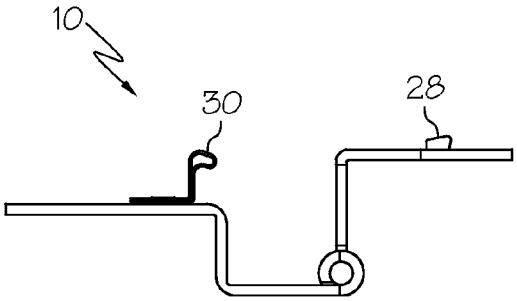
FIGS. 3 through 8 show top views of the hinge of the present invention in various positions ranging from open (FIG. 3) to closed (FIG. 7).
Figure 4:
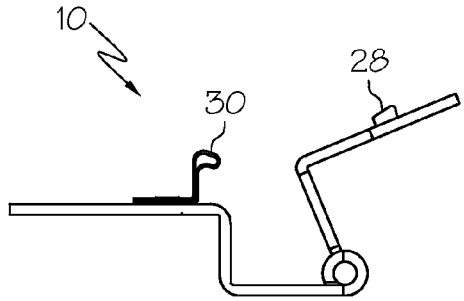
Figure 5:
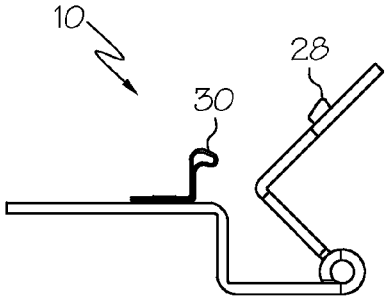
Figure 6:
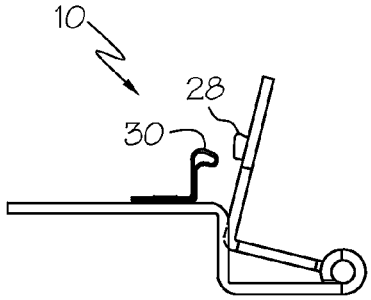
Figure 7:
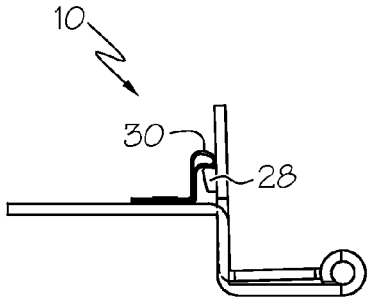

FIG. 3 is a top view of an unattached hinge in open position. FIGS. 4 and 5 show the hinge in partially closed position. In FIG. 6 the narrow section of the door wing just begins to fit into the aperture of the frame wing. In FIG. 7 the hinge is closed and the strike 28 is engaged with the catch 30.

Figure 8:
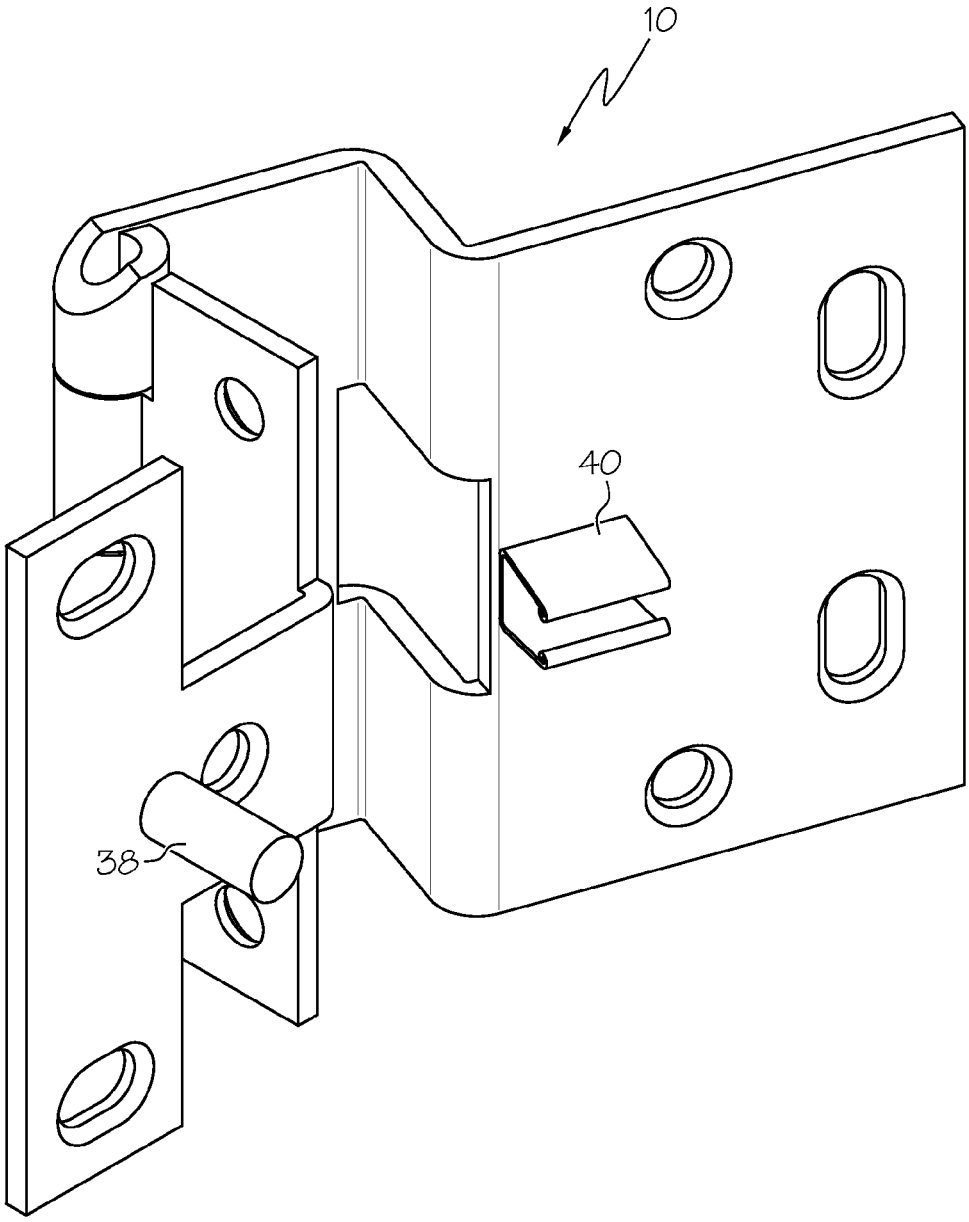

FIG. 8 discloses another example of a hinge with a unique strike and catch. In this example the strike 38 is cylindrical and the catch 40 has two prongs or wings. When the hinge is in closed position the strike 38 will be fully seated between the prongs or wings of the catch 40.

Figure 9:
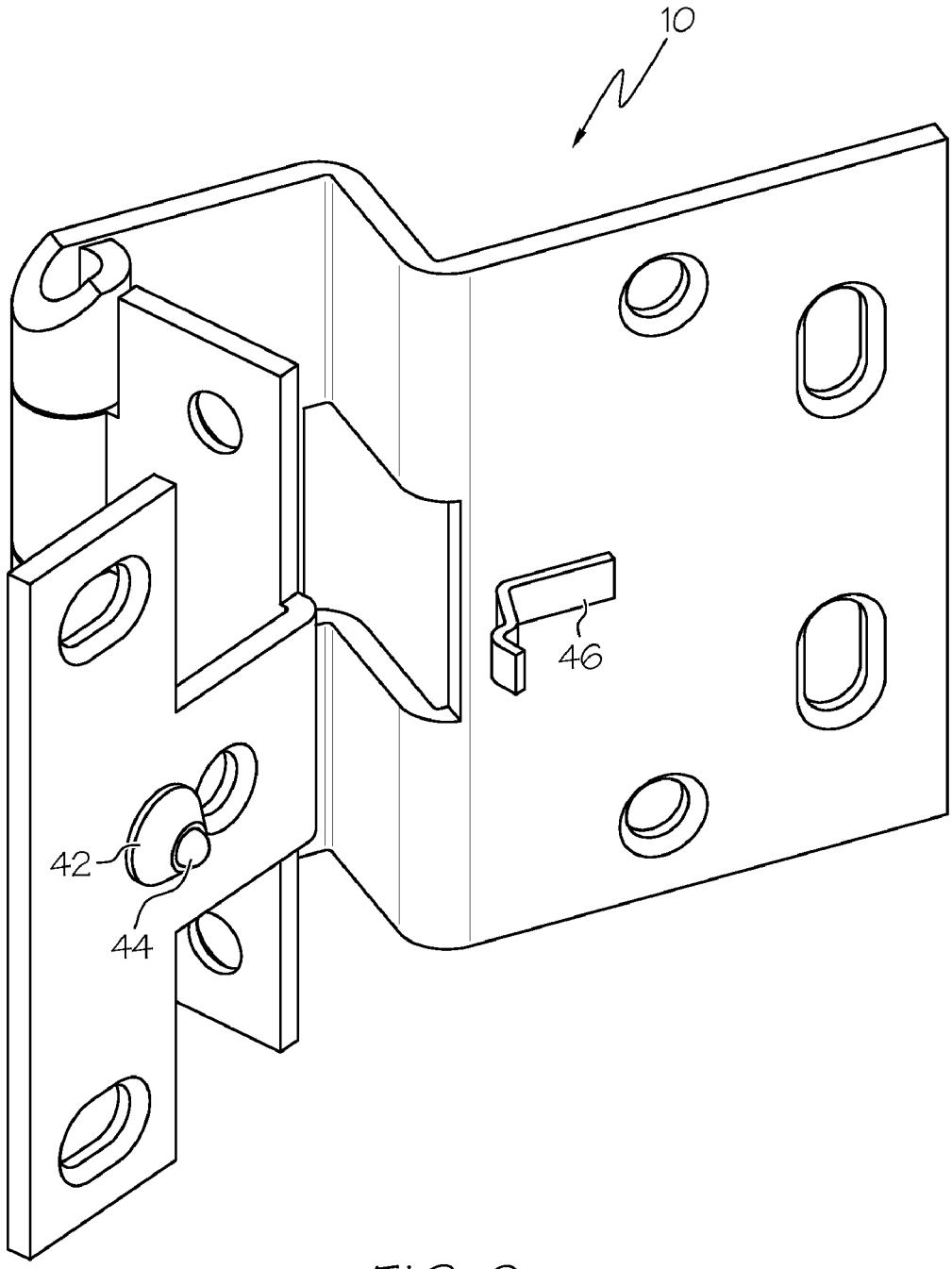

Yet another example of a strike and catch is illustrated in FIG. 9. Here the strike mechanism is composed of a ball bearing base 42 and a ball bearing strike 44. This example utilizes a single wing catch 46 that engages the ball bearing strike when the hinge (and cabinet door) is closed.

CONCLUSIONS, OTHER EMBODIMENTS, AND SCOPE OF INVENTION

As shown in the accompanying illustrations, examples of the present invention disclose a hinge device to keep a cabinet door closed without the use of non-hinge components. Use of this device will eliminate the need to use a magnetic strike and/or catch on the non-hinge end of the cabinet door and cabinet frame. This greatly reduces the time and materials to install cabinet doors. Elimination of a magnetic or mechanical catch or lock on the non-hinge end of the cabinet reduces the hardware needed and reduces the time necessary to install and align such devices to keep a cabinet door closed.

The force necessary to open a door utilizing this type of hinge is determined by the resistant force of the hinge(s) due to the strike and catch combination and the width of the door member (assuming the force is exerted at or near the end of the door). The pull force to open a typical twenty-four (24) inch wide cabinet door utilizing a standard magnetic or mechanical catch is approximately fifteen (15) lbs. The combination of strike and catch in the examples of the present invention can be adapted to accommodate a wide range of pull forces to meet the needs of the particular installation.

Although hinges of this type may be most applicable in cabinet doors, use of these hinges in other applications such as, but not limited to, lockers and closets is envisioned. As illustrated, the strike is connected to a door wing flange and the catch is connected to a frame wing flange. In another variation the strike could be connected to a frame wing flange and the catch could be connected to a door wing flange.

There are numerous varieties of strikes and catches that could be utilized with this door wing and frame wing configuration. Many types of projections or bosses could be utilized as a strike. The respective catch configuration could vary as well with one or two winged versions the most applicable. In addition, either the strike or catch or both could be adjustable to account for varying door configurations and security and/or operational requirements.

Other examples of the invention will be apparent to those skilled in the art from a consideration of the specification or practice of the invention disclosed herein. It should be evident that this disclosure is by way of example and that various changes may be made by adding, modifying, or eliminating details without departing from the fair scope of the teaching contained in this disclosure. The scope of the invention is therefore not limited to particular details of this disclosure except to the extent that the following claims are necessarily so limited. Thus it is intended that the specification and examples be considered as illustrative only, with the true scope and spirit of the invention being indicated by the following claims.

What is claimed is:

1. A door hinge comprising:

a door wing having first and second door wing flanges substantially orthogonal to each other, said second door wing flange comprising knuckles, said first door wing flange comprised of a first section and a second section, wherein said second section is narrower than said first section;

a frame wing pivotally connected to said door wing, said frame wing comprised of a first frame wing flange, a second frame wing flange substantially orthogonal to said first frame wing flange, and a third frame wing flange substantially orthogonal to said second frame wing flange, said third frame wing flange comprising knuckles; wherein said second frame wing flange comprises an aperture to receive said narrow second section of said first door wing flange when said door hinge is in a closed position; wherein said door wing is pivotally attached to said frame wing via said door wing knuckles on said second door wing flange and said frame wing knuckles on said third frame wing flange;

at least one strike or catch connected to said door wing on a door wing flange that does not comprise knuckles;

at least one strike or catch attached to a frame wing flange that does not comprise knuckles, whereby said at least one door wing strike or catch is positioned to engage said at least one frame wing strike or catch when said door hinge is in a closed position;

wherein said at least one strike is comprised of a ball bearing member seated on a base attached to said wing, and the gap between said second door wing flange and said third frame wing flange is less than half of the outside diameter of the hinge knuckles when said door hinge is in a closed position.

2. The door hinge of claim 1 wherein said at least one catch is comprised of at least one wing to engage said ball bearing member.

3. A door hinge comprising:

a door wing having first and second door wing flanges substantially orthogonal to each other, said second door wing flange comprising knuckles, said first door wing flange comprised of a first section and a second section, wherein said second section is narrower than said first section;

a frame wing pivotally connected to said door wing, said frame wing comprised of a first frame wing flange, a second frame wing flange substantially orthogonal to said first frame wing flange, and a third frame wing flange substantially orthogonal to said second frame wing flange, said third frame wing flange comprising knuckles; wherein said second frame wing flange comprises an aperture to receive said narrow second section of said first door wing flange when said door hinge is in a closed position; wherein said door wing is pivotally attached to said frame wing via said door wing knuckles on said second door wing flange and said frame wing knuckles on said third frame wing flange;

at least one strike or catch connected to said door wing on a door wing flange that does not comprise knuckles;

at least one strike or catch attached to a frame wing flange that does not comprise knuckles, whereby said at least one door wing strike or catch is positioned to engage said at least one frame wing strike or catch when said door hinge is in a closed position;

and the surface of the door wing flange upon which said at least one strike or catch is attached is substantially orthogonal to the surface of the frame wing flange upon which said at least one strike or catch is attached;

wherein said at least one strike is comprised of a cylindrical shape and said at least one catch is comprised of at least two wings to engage said cylindrical strike; and the gap between said second door wing flange and said third frame wing flange is less than half of the outside diameter of the hinge knuckles when said door hinge is in a closed position.

* * * * *